US011773621B2

(12) United States Patent
Liu et al.

(10) Patent No.: US 11,773,621 B2
(45) Date of Patent: Oct. 3, 2023

(54) ELECTRONIC KEY STORAGE CASE

(71) Applicant: SUZHOU JINLIN METAL CO., LTD, Suzhou (CN)

(72) Inventors: Andrew Liu, Suzhou (CN); Smith Chen, Suzhou (CN)

(73) Assignee: SUZHOU JINLIN METAL CO., LTD, Suzhou (CN)

( * ) Notice: Subject to any disclaimer, the term of this patent is extended or adjusted under 35 U.S.C. 154(b) by 549 days.

(21) Appl. No.: 17/055,992

(22) PCT Filed: Apr. 22, 2019

(86) PCT No.: PCT/CN2019/083625
§ 371 (c)(1),
(2) Date: Nov. 17, 2020

(87) PCT Pub. No.: WO2019/218846
PCT Pub. Date: Nov. 21, 2019

(65) Prior Publication Data

US 2021/0214969 A1 Jul. 15, 2021

(30) Foreign Application Priority Data

May 17, 2018 (CN) ..... 201810471103.4

(51) Int. Cl.
*E05B 19/00* (2006.01)
*A45C 11/32* (2006.01)
(Continued)

(52) U.S. Cl.
CPC ..... *E05B 19/0005* (2013.01); *A45C 11/32* (2013.01); *E05B 49/00* (2013.01);
(Continued)

(58) Field of Classification Search
CPC .... E05B 19/0005; E05B 49/00; E05B 67/063; A45C 11/32; F21V 23/0471; F21Y 2115/10
See application file for complete search history.

(56) References Cited

U.S. PATENT DOCUMENTS 3,867,823 A 2/1975 Waltower
4,659,121 A * 4/1987 McGee ..... E05B 47/0002 292/144
(Continued)

FOREIGN PATENT DOCUMENTS

CN 201261981 Y 6/2009
CN 203594282 U 5/2014
(Continued)

OTHER PUBLICATIONS

European Search Report received for EP Application No. 19802982.9 dated May 11, 2021, 7 Pages.
(Continued)

*Primary Examiner* — Mark A Williams
(74) *Attorney, Agent, or Firm* — EcoTech Law Group, P.C.

(57) ABSTRACT

The present invention discloses an electronic key storage case, comprising a housing, a cavity defined in the housing and configured for storage, a front panel configured for password input and disposed on the front of the housing, a locking mechanism and a control circuit disposed on an inner side of the front panel, characterized in that, the locking mechanism is an electronic lock, and comprises a driving circuit, a lock tongue, and a mounting assembly connected with the lock tongue, the driving circuit is configured to receive unlocking information from the control circuit and control an action on the lock tongue, the mounting assembly comprises a lock bracket, a rotating shaft located on the lock bracket, and a locking hook spring
(Continued)

disposed on the rotating shaft, a locking hook groove is provided on the lock tongue, and the lock tongue is matched with the locking hook spring through the driving circuit, to obtain a degree of freedom of rotating forward or reverse rotation with the rotating shaft as a central axis to form two states of the locking hook groove engaged with or separated from the locking pin. In the present invention, the key case is opened automatically in an electronic lock manner, thereby being easier to use, providing a securer lock structure, and avoiding undesirably opening.

9 Claims, 9 Drawing Sheets

(51) Int. Cl.

| | |
|---|---|
| ***E05B 49/00*** | (2006.01) |
| ***E05B 67/06*** | (2006.01) |
| ***F21V 23/04*** | (2006.01) |
| *F21Y 115/10* | (2016.01) |

(52) U.S. Cl.
CPC ..... *E05B 67/063* (2013.01); *F21V 23/0471* (2013.01); *F21Y 2115/10* (2016.08)

(56) References Cited

U.S. PATENT DOCUMENTS

| | | | | |
|---|---|---|---|---|
| 4,838,052 | A | 6/1989 | Williams et al. | |
| 4,916,443 | A * | 4/1990 | Barrett | G07C 1/32 340/5.33 |
| 5,280,518 | A * | 1/1994 | Danler | G07C 9/00817 340/5.23 |
| 5,791,172 | A * | 8/1998 | Deighton | E05B 19/0005 292/201 |
| 5,881,584 | A * | 3/1999 | Brunoski | E05B 47/0012 292/144 |
| 6,361,089 | B1 * | 3/2002 | Parker | E05C 9/08 292/210 |
| 8,950,223 | B1 * | 2/2015 | Joyce | A45C 15/06 70/159 |
| 9,540,845 | B1 * | 1/2017 | Yang | E05B 67/24 |
| 2004/0160304 | A1 * | 8/2004 | Mosgrove | G07C 9/27 713/193 |
| 2007/0159297 | A1 | 7/2007 | Paulk et al. | |
| 2008/0229792 | A1 * | 9/2008 | Maple | E05B 77/34 292/307 R |
| 2012/0000255 | A1 | 1/2012 | Nave et al. | |
| 2014/0266586 | A1 * | 9/2014 | Fisher | H04W 12/06 340/5.61 |
| 2016/0186465 | A1 * | 6/2016 | Nelson | B65D 55/14 220/230 |
| 2019/0368233 | A1 * | 12/2019 | Gengler | F16P 3/08 |

FOREIGN PATENT DOCUMENTS

| | | | |
|---|---|---|---|
| CN | 104234528 | A | 12/2014 |
| CN | 206928790 | U | 1/2018 |
| CN | 107956328 | A | 4/2018 |
| CN | 108425553 | A | 8/2018 |
| CN | 208396461 | U | 1/2019 |
| CN | 208473482 | U | 2/2019 |

OTHER PUBLICATIONS

International Search Report and Written Opinion for International Application No. PCT/CN2019/083625 dated Jul. 16, 2019, 11 Pages including 3 page of English Translation of International Search Report.

* cited by examiner

ELECTRONIC KEY STORAGE CASE

RELATED APPLICATION

This application claims the benefit from International Application No. PCT/CN2019/083625, which was granted an International filing date of Apr. 22, 2019, which in turns claims priority from CN Provisional Application having Serial No. 201810471103.4 filed on May 17, 2018, which are incorporated herein by reference for all purposes.

FIELD OF THE INVENTION

The present invention relates to a key case, and in particular to an electronic key storage case.

BACKGROUND TECHNIQUE

A key case, as the name suggests, is a case used for storing keys. Generally, people are accustomed to carrying a large bunch of door keys when going out, including keys of an apartment building gate, a burglar-proof door, a garage door, a mailbox door, and the like. It is very inconvenient to carry the keys around, and there is also a possibility of forgetting or losing the keys. Therefore, a key case used for storing key has emerged.

The conventional key cases are mainly mechanical locks. For example, "PASSWORD LOCK OF KEY CASE" (CN104234528A) disclosed in the Chinese patent application comprises a lock ring, a rear lock body, a front lock body, a rear lock gate assembly, a lock gate base, and a lock head. The front lock body is hinged with the rear lock body. The front lock body and the rear lock body are closed to form a cavity for accommodating keys. The lock gate base is fixedly mounted in the rear lock body. The lock head comprises a housing, inner password wheels, an outer password wheel, a central shaft, a password-wheel elastic member, a front lock gate assembly, and a control panel. The housing is fixed on the front lock body. The front lock gate assembly is positioned on a side of the housing facing the rear lock body, and the front lock gate assembly can elastically slide along the depth direction of a concave pit in a groove provided in the lock gate base. The central shaft is axially slidably inserted by a specified distance into an interior of a side of the housing facing the front lock body. The password-wheel elastic member and several inner password wheels are sequentially sleeved outside the central shaft. The outer password wheel is sleeved outside the inner password wheels and can actuate the inner password wheels to rotate. Both ends of the password-wheel elastic member in the axial direction closely abut against an inner sidewall of the housing and an axial end surface of the inner password wheel adjacent to the password-wheel elastic member respectively. The central shaft can actuate the inner password wheels to axially slide and separate from the outer password wheel. A password label on an outer circumferential sidewall of the outer password wheel can be exposed from an outer side of the front lock body. A concave structure is provided in an outer circumferential side surface of the inner password wheel. One end of the control panel closely abuts against the outer circumferential side surface of the inner password wheel, and the other end of the control panel closely abuts against a side of the front lock gate assembly facing away from the concave pit of the lock gate base. An antenna that can extend into a strip-shaped groove of the lock gate base is disposed on the other end of the control panel, and the antenna can limit contraction of the rear lock gate assembly along the length direction. In use, when the password is a correct unlocking password, the front lock body can be opened.

As described above, on the one hand, a mechanical character-wheel password lock is structurally complex, resulting in inconvenience in unlocking and password setting. On the other hand, after the password is correctly entered, the lock still needs to be unlocked manually. More importantly, all locksets currently used in this type of key cases implement locking by fitting a lock tongue to a keyhole. The lock tongue uses an elastic force of a single spring as a locking force to support closure between the lock tongue and the keyhole. After being knocked and shaken by an external force, a lockset inevitably has a problem of being unlocked by mistake, and has relatively poor security.

Therefore, a key case that is convenient to open and that has a higher security level needs to be developed, to resolve the problems in conventional products.

SUMMARY OF THE INVENTION

An objective of the present invention is to provide an electronic key storage case, which is more convenient to open, has higher security, and has a wider application range through structural improvement.

To achieve the foregoing objective, a technical solutions used in the present invention is: an electronic key storage case comprises a housing, a cavity defined in the housing and configured for storage, a front panel configured for password input and disposed on the front of the housing, a locking mechanism and a control circuit disposed on an inner side of the front panel, characterized in that, the locking mechanism is an electronic lock and comprises a driving circuit, a lock tongue, and a mounting assembly connected to the lock tongue, the driving circuit is configured to receive unlocking information from the control circuit and control an action on the lock tongue; the mounting assembly comprises a lock bracket, a rotating shaft located on the lock bracket, and a locking hook spring disposed on the rotating shaft, the lock tongue is sleeved on the rotating shaft, an acting end of the locking hook spring is connected to the lock tongue, a locking hook groove is provided on the lock tongue, and the locking hook groove is matched with a locking pin on the housing, and the lock tongue cooperates with the locking hook spring through the driving circuit, to obtain a degree of freedom of forward or reverse rotation with the rotating shaft as a central axis to form two states of the locking hook groove engaged with or separated from the locking pin.

In the foregoing technical solution, the driving circuit comprises a power supply, a driving control unit and a motor, the driving control unit controls rotation of the motor, a cam structure is disposed on a main shaft outputted by the motor, the rotating shaft of the mounting assembly and the main shaft are disposed in parallel, and an outer edge surface of the lock tongue is connected with the cam structure.

In a further technical solution, the cam structure is that, an oblique notch is provided on a side of the main shaft, and the outer edge surface of the lock tongue is matched with the oblique notch.

In the foregoing technical solution, a locking recess, an unlocking positioning groove, and a limiting protrusion are sequentially provided on the outer edge surface of the lock tongue, the locking recess is matched with an outer edge surface of the main shaft, the unlocking positioning groove is matched with the oblique notch, and the limiting protrusion abuts against a junction between the oblique notch and the outer edge surface of the main shaft to limit the lock tongue to an unlocking state, and the acting end of the locking hook spring is buckled onto the limiting protrusion to enable the lock tongue to rotate toward a side of the main shaft with the rotating shaft as a center.

In the foregoing technical solution, a return spring is sleeved on the main shaft of the motor, and the motor is driven by the power supply to rotate forward, and is returned by a reverse force of the return spring.

In the foregoing technical solution, the locking hook groove on the lock tongue is formed by two groove sidewalls and an inward concave arc surface, one groove sidewall extends outward to form a locking pressing block, the locking pin acts on the locking pressing block to make the lock tongue to rotate reversely, so that the locking hook spring is extended and the state of the locking hook groove engaged with the locking pin is formed.

In the foregoing technical solution, a plurality of fixing screw holes are provided on a back side of the housing, and the housing is fixedly mounted on a wall beside a door by bolts.

In the foregoing technical solution, a hook structure is disposed at the top of the housing, the hook structure comprises a hook located on an outer side of the housing and a hook locking plate located on an inner side of the housing, and an end portion of the hook passes through a mounting hole at the top of the housing and is fixed in the housing by the hook locking plate.

In the foregoing technical solution, a protective cover is disposed on an outer side of the front panel, one end of the protective cover is pivotally connected to a bottom surface of the housing by a pin shaft, and the other end of the protective cover is connected with a top surface of the housing by a buckle in an engaged manner.

In the foregoing technical solution, an LED lighting lamp and a key hook are disposed on an inner wall of the housing, a delay switch of the LED lighting lamp is connected to the control circuit, when the front panel of the housing is opened, the LED lighting lamp is switched on, and the LED lighting lamp is automatically switched off after a delay of the delay switch.

Due to the application of the foregoing technical solutions, compared with the prior art, the present invention has one or more of the following advantages:

1. In the present invention, a driving circuit is used to control the movement of the lock tongue to achieve electronic automatic unlocking. That is, when the control circuit transmits a signal to the driving circuit, the driving circuit drives the lock tongue to move and separate from the locking pin, thereby opening the housing. Compared with the conventional structure, there is no need to click an unlocking button or a similar button after inputting a password, thereby improving user experience.

2. The locking mechanism comprises a lock tongue, a motor, a main shaft, and a return spring. The lock tongue is connected with the main shaft by a cam structure. When the motor rotates, the lock tongue is actuated to rotate together from a locking recess to an unlocking positioning groove, and is limited by a limiting protrusion, that is, it is turned from a locking state to an unlocking state. On the contrary, the lock tongue is pushed by the locking pin to rotate reversely, the return spring makes the main shaft return and be matched with the locking recess to complete locking of the housing. The limiting protrusion and the locking recess of the lock tongue are used to cooperate with the cam structure of the main shaft to achieve unlocking and locking. The structure is compact and ingenious, and a vertical movement manner of the lock tongue is changed into a rotation manner, thereby having stronger resistance to external percussion and vibration, preventing undesirably opening, and improving the safety of use.

3. In the present invention, a protective cover is disposed on an outer side of a front panel of the housing, to provide good waterproof and dustproof protection, so that it is suitable for installation in an open air environment, and the service life is prolonged.

4. A LED lighting lamp is disposed in the housing, to provide use convenience at night or in a low light environment. Once the housing is opened, the LED lighting lamp is switched on and is delayed for a period of time, which is sufficient to take out a key and unlock a door. When the delay expires, the LED lighting lamp is switched off automatically to reduce battery consumption.

5. There are two manners of mounting the housing: one is to directly fix the back surface of the housing by bolts, and the other is hanging the housing by a hook structure. The mounting manner can be determined according to an actual use environment, which is convenient and flexible use.

Figure 1:
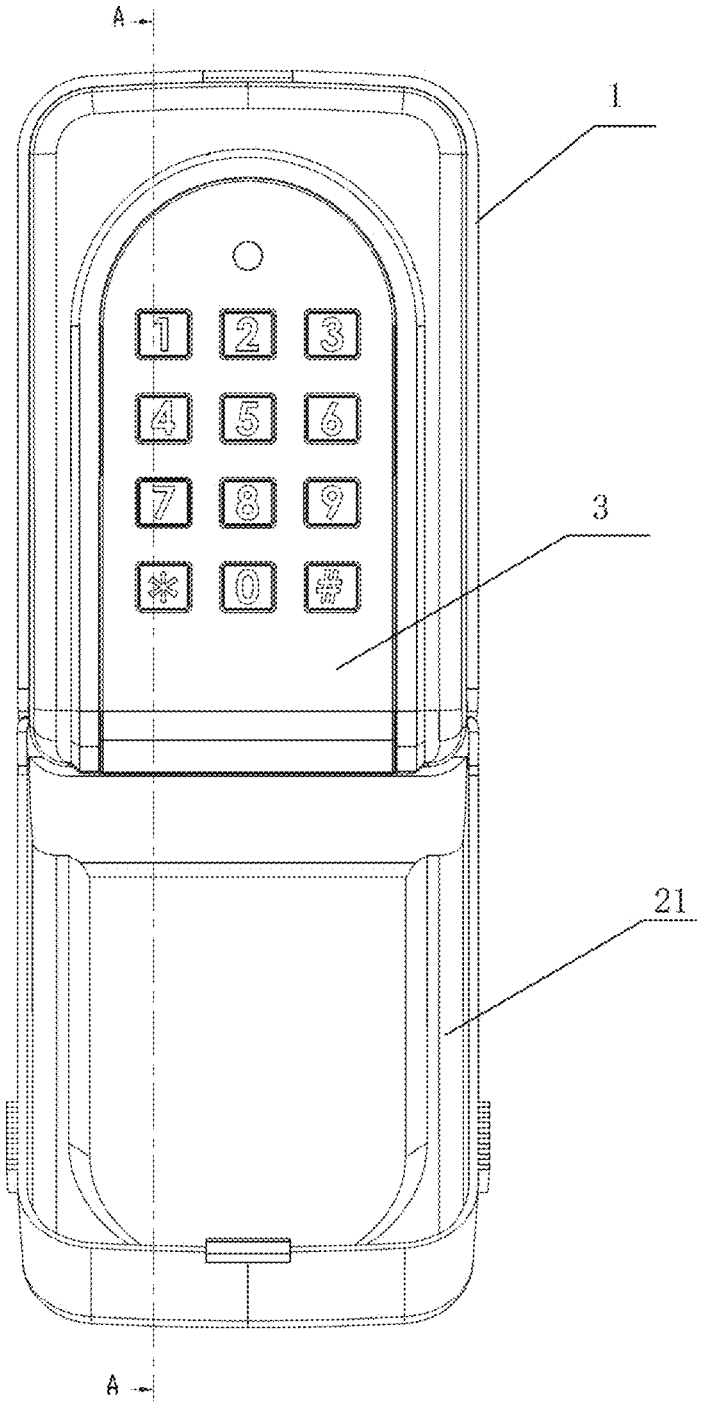
FIG. 1 is a schematic structural diagram according to a first embodiment of the present invention.

In the figures: 1. Housing; 2. Cavity; 3. Front panel; 4. Locking mechanism; 5. Lock tongue; 6. Mounting assembly; 7. Lock bracket; 8. Rotating shaft; 9. Locking hook spring; 10. Locking hook groove; 11. Locking pin; 12. Battery; 13. Motor; 14. Main shaft; 15. Oblique notch; 16. Locking recess; 17. Unlocking positioning groove; 18. Limiting protrusion; 19. Return spring; 20. Locking pressing block; 21. Protective cover; 22. Fixing screw hole; 23. LED lighting lamp; 24. Key hook; 25. Hook; 26. Hook locking plate; 27. Compression spring.

DETAILED DESCRIPTION OF THE INVENTION

The following further describes the present invention with reference to the accompanying drawings and specific embodiments:

First embodiment: referring to FIG. 1 to FIG. 9, an electronic key storage case comprises a housing 1, a cavity 2 defined in the housing 1 and configured for storage, a front panel 3 configured for password input and disposed on the front of the housing 1, and a locking mechanism 4 and a control circuit disposed on an inner side of the front panel 3. The locking mechanism 4 is an electronic lock, and comprises a driving circuit, a lock tongue 5, and a mounting assembly 6 connected with the lock tongue 5.

The driving circuit is configured to receive unlocking information from the control circuit and control an action on the lock tongue 5.

The mounting assembly 6 comprises a lock bracket 7, a rotating shaft 8 located on the lock bracket 7, and a locking hook spring 9 disposed on the rotating shaft 8. The lock tongue 5 is sleeved on the rotating shaft 8, an acting end of the locking hook spring 9 is connected to the lock tongue 5. A locking hook groove 10 is provided on the lock tongue 5, and the locking hook groove 10 is matched with a locking pin 11 on the housing 1.

The lock tongue 5 cooperates with the locking hook spring 9 through the driving circuit to obtain a degree of freedom of forward or reverse rotation with the rotating shaft 8 as a central axis, to form two states of the locking hook groove 10 engaged with or separated from the locking pin 11.

Figure 7:
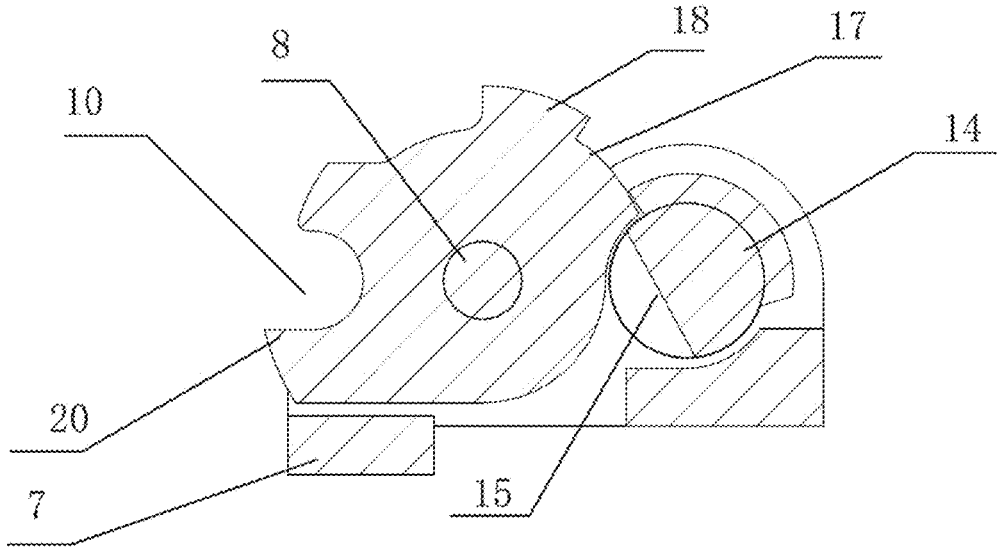
FIG. 7 is a schematic semi-cross-sectional view of FIG. 6.
Figure 9:
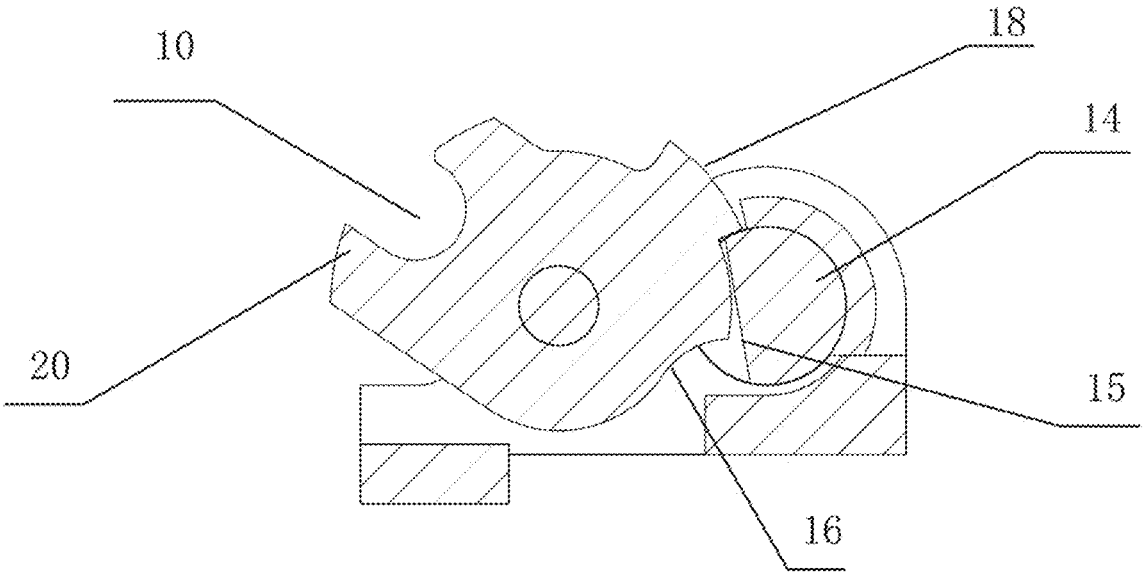
FIG. 9 is a schematic semi-cross-sectional view of FIG. 8.

As shown in FIG. 7 and FIG. 9, the driving circuit comprises a battery 12, a driving control unit, and a motor 13. The driving control unit controls rotation of the motor 13, a cam structure is disposed on a main shaft 14 outputted by the motor 13, the rotating shaft 8 in the mounting assembly 6 and the main shaft 14 are disposed in parallel, and an outer edge surface of the lock tongue 5 is connected with the cam structure. In this embodiment, the cam structure is that, an oblique notch 15 is provided on a side of the main shaft 14, and the outer edge surface of the lock tongue 5 is matched with the oblique notch 15. A distance from the oblique notch 15 to a center of a circle is less than a radius, so that a cam effect is formed. The lock tongue 5 is matched with the outer edge surfaces at different distances to switch from one state to another state. The specific matching manner is as follows:

A locking recess 16, an unlocking positioning groove 17, and a limiting protrusion 18 are sequentially provided on the outer edge surface of the lock tongue 5. The locking recess 16 is matched with an outer edge surface of the main shaft 14, the unlocking positioning groove 17 is matched with the oblique notch 15, and the limiting protrusion 18 abuts against a junction between the oblique notch 15 and the outer edge surface of the main shaft 14 to limit the lock tongue 5 to an unlocking state, and the acting end of the locking hook spring 9 is buckled onto the limiting protrusion 18 to enable the lock tongue 5 to rotate toward a side of the main shaft 14 with the rotating shaft 8 as a center.

Figure 8:
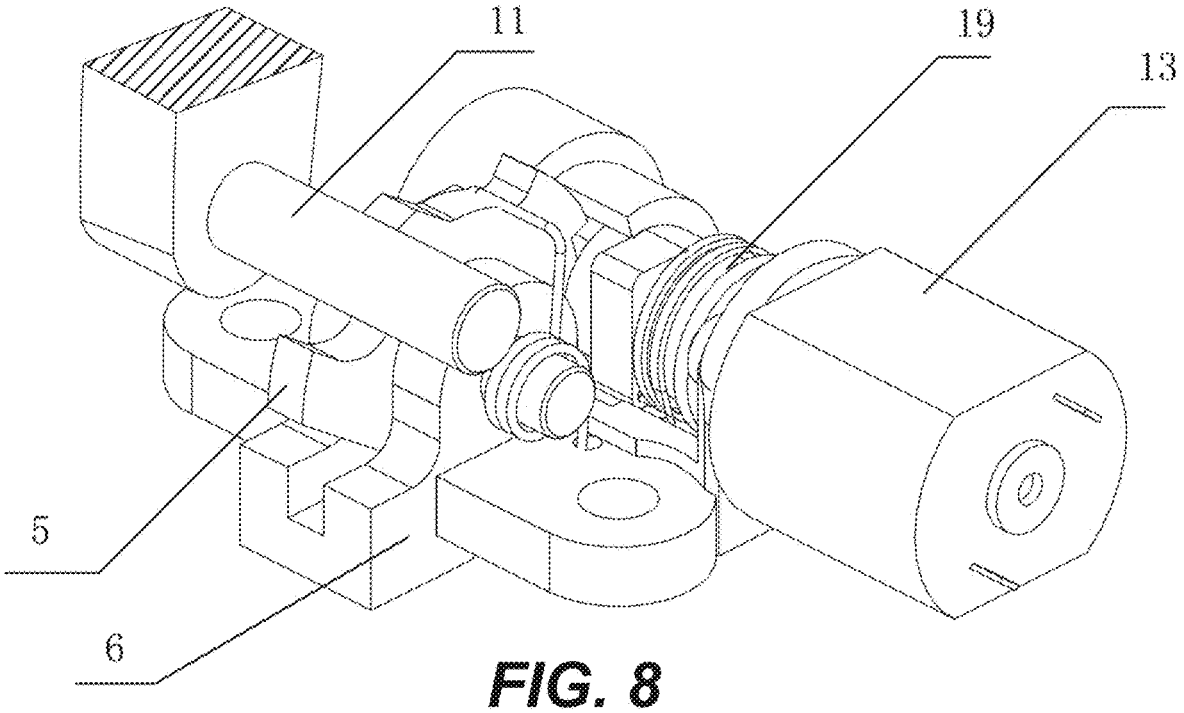
FIG. 8 is a schematic diagram showing a state of the lock tongue separated from the locking pin according to the first embodiment of the present invention.

When the main shaft 14 rotates forward (rotates clockwise), the oblique notch 15 is turned to the lock tongue 5. Under the acting force of the locking hook spring 9, the lock tongue 5 rotates toward the side of the main shaft 14 from the locking recess 16 to the unlocking positioning groove 17 until abutting against the limiting protrusion 18 as shown in FIG. 9. In this state, the locking hook groove 10 of the lock tongue 5 is separated from the locking pin 11. As shown in FIG. 8, the front panel 3 of the housing 1 is automatically opened under the action of gravity.

On the contrary, when the front panel 3 is closed, the main shaft 14 and the lock tongue 5 need to be returned respectively. A return spring 19 is sleeved on the main shaft 14 of the motor 13 to enable the main shaft 14 to rotate reversely (rotate anticlockwise). The locking hook groove 10 on the lock tongue 5 is formed by two groove sidewalls and an inward concave arc surface. One groove sidewall extends outward to form a locking pressing block 20. The locking pin 11 acts on the locking pressing block 20 to make the lock tongue 5 to rotate reversely, thereby extending the locking hook spring 9, and forming the state of the locking hook groove 10 engaged with the locking pin 11.

Figure 6:
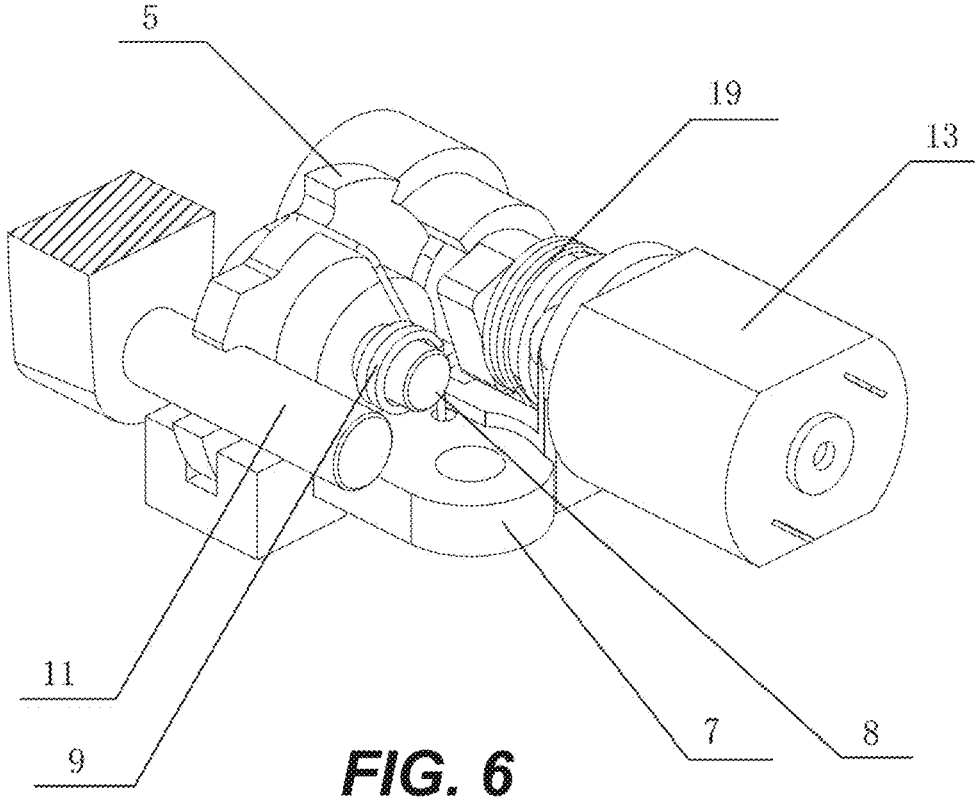
FIG. 6 is a schematic diagram showing a state of a lock tongue engaged with a locking pin according to the first embodiment of the present invention.

When the front panel 3 is shut down, the front panel 3 is closed. Since the locking pin 11 pushes the locking pressing block 20 on the lock tongue 5, the lock tongue 5 is switched from the unlocking positioning groove 17 to the locking recess 16. In this case, the main shaft 14 rotates reversely under the force of the return spring 19, the oblique notch 15 rotates downward, and the outer edge surface of the main shaft 14 abuts against the locking recess 16 of the lock tongue 5. As shown in FIG. 7, the lock tongue 5 is locked and cannot be turned back. In this case, the locking hook groove 10 is engaged with the locking pin 11. As shown in FIG. 6, the front panel 3 of the housing 1 is locked.

In switching between two states of engagement and separation, the locking hook spring 9 and the return spring 19 are mutual cooperated each other, so that the driving circuit only needs to drive the motor 13 to rotate toward one direction without considering a driving force for returning by using a dry cell battery 12 (direct current), leading to simplified driving, convenience in mounting, and a smaller and more compact structure.

Figure 2:
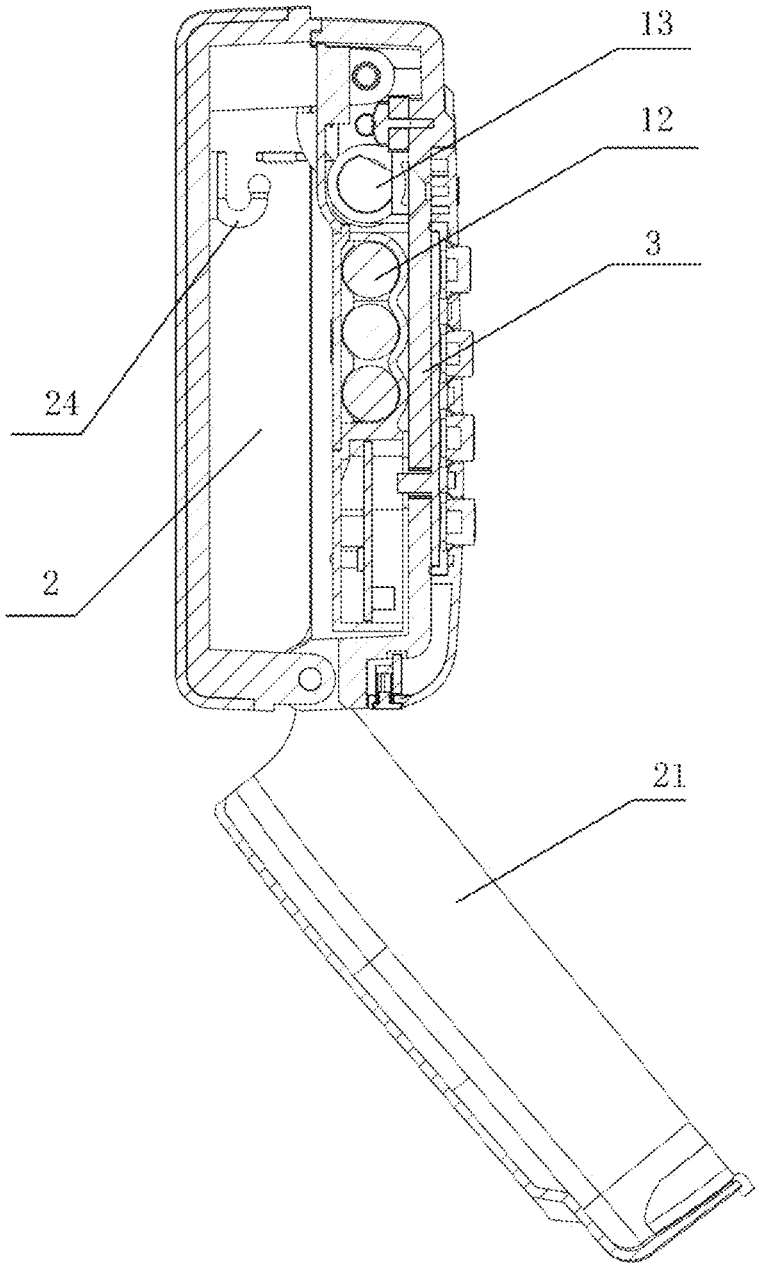
FIG. 2 is a schematic cross-sectional view of FIG. 1 along an A-A line.
Figure 3:
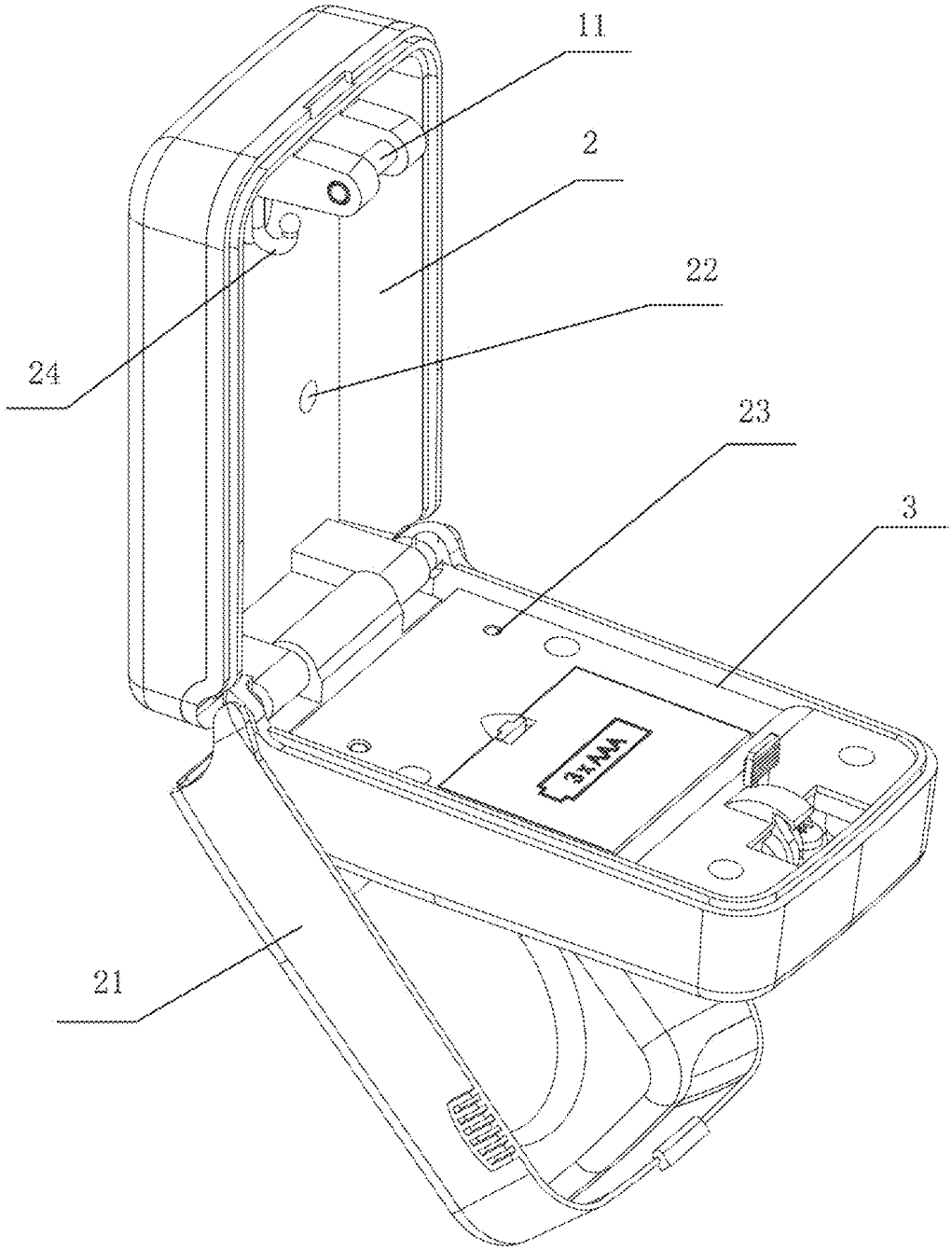
FIG. 3 is a schematic diagram of a housing in an open state according to the first embodiment of the present invention.

As shown in FIG. 2 and FIG. 3, a protective cover 21 is disposed on an outer side of the front panel 3, one end of the protective cover 21 is pivotally connected with a bottom surface of the housing 1 by a pin shaft, and the other end of the protective cover 21 is connected with a top surface of the housing 1 by a buckle in an engaged manner. Dustproof and waterproof protection on the front panel 3 of the housing 1 is achieved. The protective cover 21 is opened to input an unlocking password. A plurality of fixing screw holes 22 are provided on a back side of the housing 1, and the housing 1 is fixedly mounted on a wall beside a door by bolts.

Figure 4:
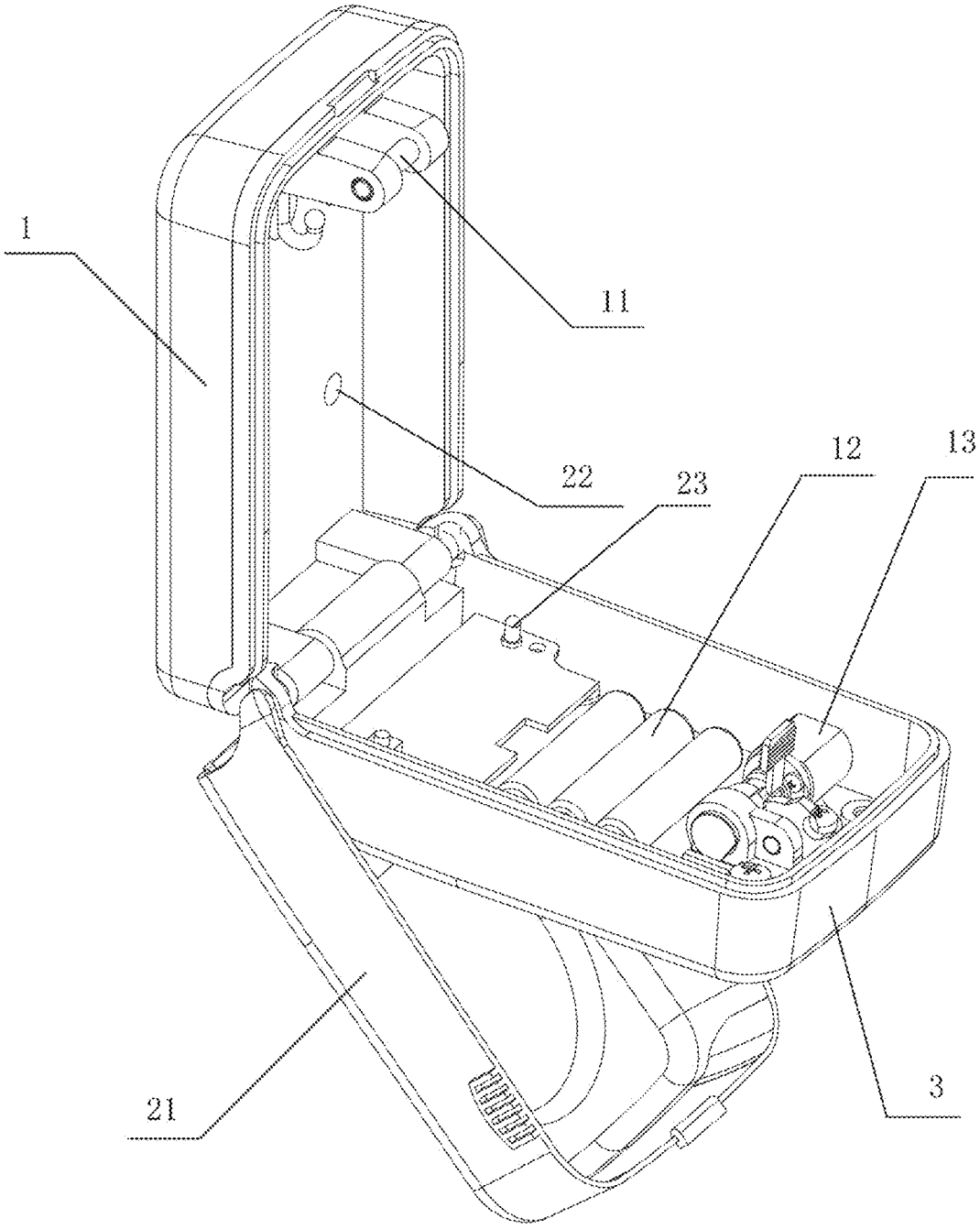
FIG. 4 is a schematic diagram of FIG. 3 after a battery and an upper cover plate of a lock structure are removed.
Figure 5:
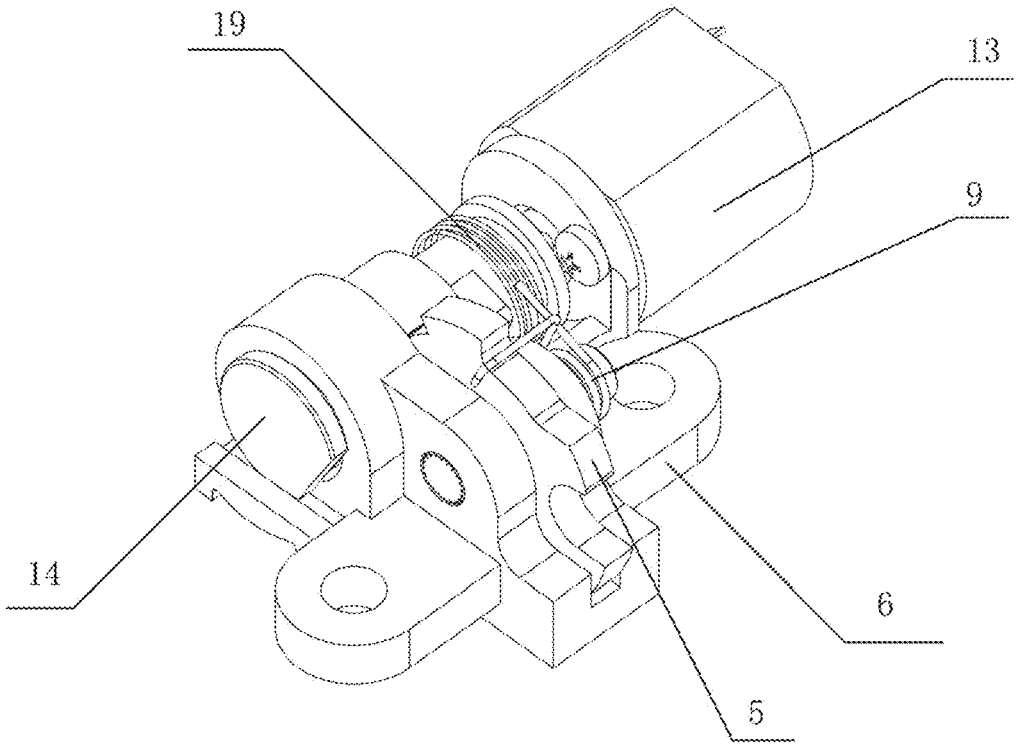
FIG. 5 is a schematic diagram of a lock structure according to the first embodiment of the present invention.

As shown in FIG. 4, an LED lighting lamp 23 and a key hook 24 are disposed on an inner wall of the housing 1. A delay switch of the LED lighting lamp 23 is connected with the control circuit. When the front panel of the housing 1 is opened, the LED lighting lamp 23 is switched on, and the LED lighting lamp is automatically switched off after a delay of the delay switch.

An emergency socket is further provided on the outer side of the housing 1. When the battery 12 is low, an external power supply (for example, an existing mobile power supply) can be plugged in the emergency socket, so that an emergence start is implemented. After a correct password is inputted, the housing 1 is opened, and the battery is replaced with a new battery 12, to resume normal use.

Figure 10:
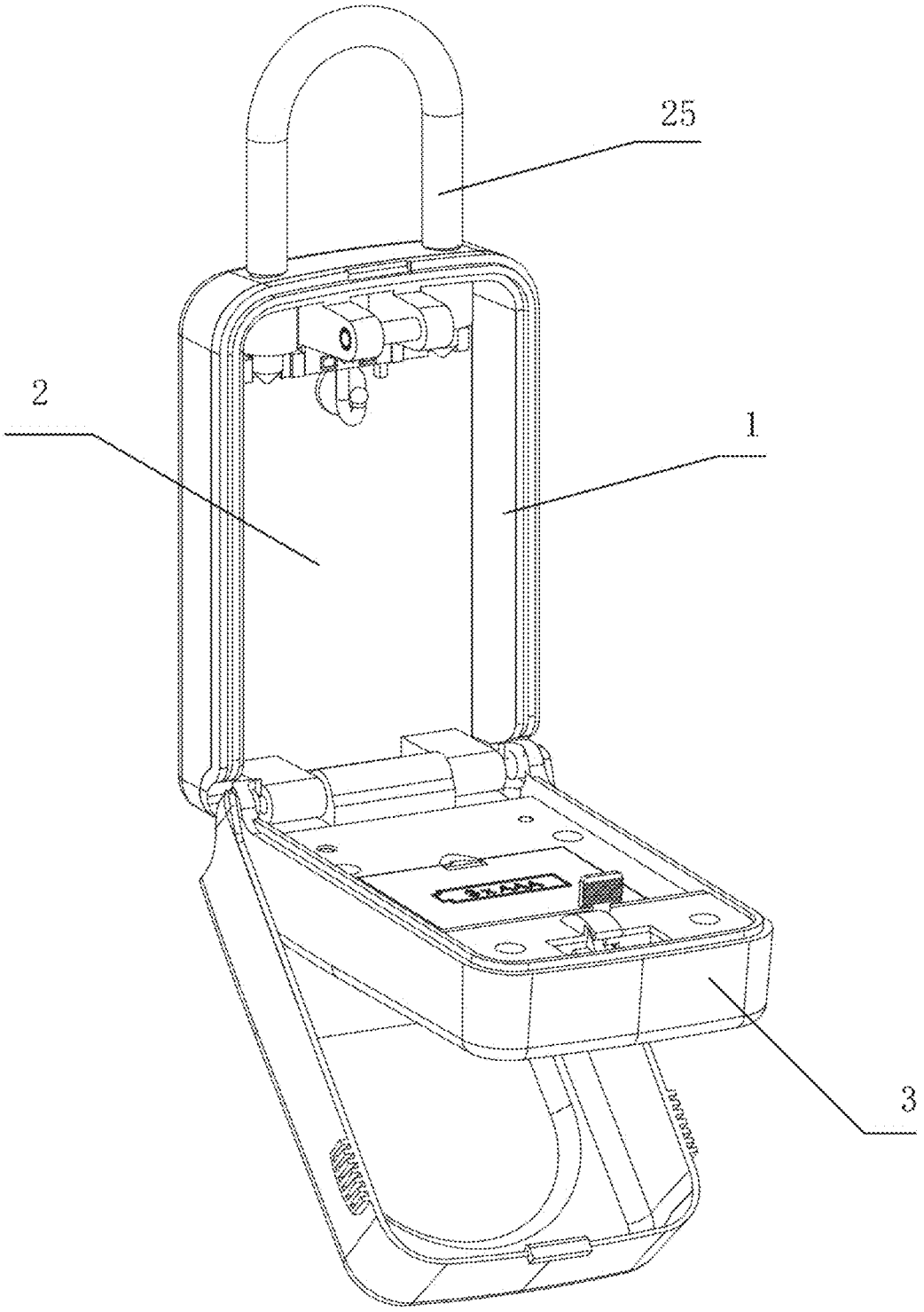
FIG. 10 is a schematic structural diagram according to a second embodiment of the present invention.
Figure 11:
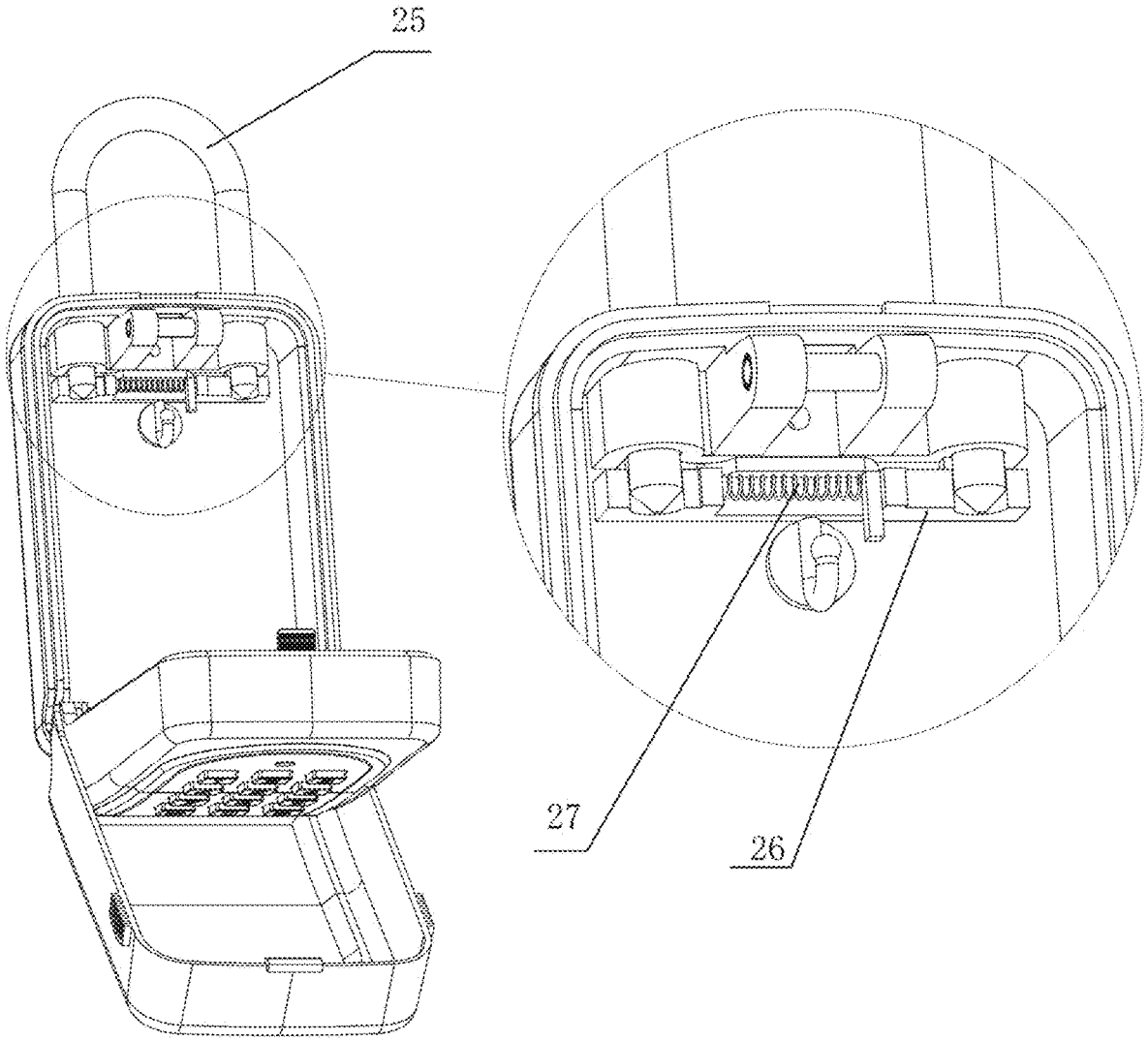
FIG. 11 is a schematic diagram of mounting of a hook structure according to the second embodiment of the present invention.

Second embodiment: referring to FIG. 10 and FIG. 11, an electronic key storage case comprises a housing 1, a cavity 2 defined in the housing 1 and configured for storage, a front panel 3 configured for password input and disposed on the front of the housing 1, and a locking mechanism 4 and a control circuit disposed on an inner side of the front panel 3. The locking mechanism 4 is an electronic lock, and comprises a driving circuit, a lock tongue 5, and a mounting assembly 6 connected with the lock tongue 5. In this embodiment, the electronic key storage case has similar structure with that of the first embodiment, except that, an alternating current may be chosen as input of the driving circuit, so that positive and negative paths of the motor is controlled by the driving control unit to achieve forward and reverse rotation of the main shaft. Therefore, in this embodiment, there is no need to use the return spring to return the main shaft. This solution is not as simple in structure as the first embodiment, and double springs in the first embodiment are preferred.

As shown in FIG. 10, a hook structure is disposed at the top of the housing 1. The hook structure comprises a hook 25 located on an outer side of the housing 1 and a hook locking plate 26 located on an inner side of the housing 1. An end portion of the hook 25 passes through a mounting hole at the top of the housing 1 and is fixed in the housing 1 by the hook locking plate 26. As shown in FIG. 11, if the hook locking plate 26 is moved, the hook 25 may come out. The hook 25 is clamped by a compression spring 27 during locking, to achieve a connection between the hook 25 and the housing 1. If a mounting manner using the hook structure is adopted, there is no need to open holes on the housing 1 and a mounting wall, and the mounting is more convenient.

What is claimed is:

1. An electronic key storage case, comprising:

a housing having defined therein a cavity;

a front panel configured for password input and disposed on the front of the housing;

a locking mechanism and a control circuit disposed on an inner side of the front panel, wherein the locking mechanism is an electronic lock and comprises a driving circuit, a lock tongue and a mounting assembly connected with the lock tongue;

wherein the driving circuit is configured to receive unlocking information from the control circuit and control an action on the lock tongue;

wherein the mounting assembly comprises a lock bracket, a rotating shaft located on the lock bracket, and a locking hook spring disposed on the rotating shaft, the lock tongue is sleeved on the rotating shaft, an acting end of the locking hook spring is connected with the lock tongue, a locking hook groove is provided on the lock tongue, and the locking hook groove is matched with a locking pin on the housing;

wherein the lock tongue cooperates with the locking hook spring through the driving circuit, to obtain a degree of freedom of forward or reverse rotation with the rotating shaft as a central axis, to form two states of the locking hook groove engaged with or separated from the locking pin; and wherein the driving circuit comprises a power supply, a driving control unit and a motor, the driving control unit controls rotation of the motor, wherein a cam structure is disposed on a main shaft outputted by the motor, the rotating shaft of the mounting assembly and the main shaft are disposed in parallel, and an outer edge surface of the lock tongue is connected with the cam structure.

2. The electronic key storage case according to claim 1, wherein the cam structure an oblique notch is provided on a side of the main shaft, and the outer edge surface of the lock tongue is matched with the oblique notch.

3. The electronic key storage case according to claim 1, wherein a locking recess, an unlocking positioning groove, and a limiting protrusion are sequentially provided on the outer edge surface of the lock tongue, the locking recess is matched with an outer edge surface of the main shaft, the unlocking positioning groove is matched with the oblique notch, and the limiting protrusion abuts against a junction between the oblique notch and the outer edge surface of the main shaft to limit the lock tongue to an unlocking state; and the acting end of the locking hook spring is buckled onto the limiting protrusion to enable the lock tongue to rotate toward a side of the main shaft with the rotating shaft as a center.

4. The electronic key storage case according to claim 1, wherein a return spring is sleeved on the main shaft of the motor, and the motor is driven by the power supply to rotate forward, and is returned by a reverse force of the return spring.

5. The electronic key storage case according to claim 1, wherein the locking hook groove on the lock tongue is formed by two groove sidewalls and an inward concave arc surface, one groove sidewall extends outward to form a locking pressing block, the locking pin acts on the locking pressing block to make the lock tongue to rotate reversely, so that the locking hook spring is extended and the state of the locking hook groove engaged with the locking pin is formed.

6. The electronic key storage case according to claim 1, wherein a plurality of fixing screw holes are provided on a back side of the housing, and the housing is fixedly mounted on a wall beside a door by bolts.

7. The electronic key storage case according to claim 1, wherein a hook structure is disposed at the top of the housing, the hook structure comprises a hook located on an outer side of the housing and a hook locking plate located on an inner side of the housing, and an end portion of the hook passes through a mounting hole at the top of the housing and is fixed in the housing by the hook locking plate.

8. The electronic key storage case according to claim 1, wherein a protective cover is disposed on an outer side of the front panel, one end of the protective cover is pivotally connected with a bottom surface of the housing by a pin shaft, and the other end of the protective cover is connected with a top surface of the housing by a buckle in an engaged manner.

9. The electronic key storage case according to claim 1, wherein an LED lighting lamp and a key hook are disposed on an inner wall of the housing, a delay switch of the LED lighting lamp is connected with the control circuit, when the front panel of the housing is opened, the LED lighting lamp is switched on, and the LED lighting lamp is automatically switched off after a delay of the delay switch.

* * * * *